United States Patent [19]

Giorgi

[11] Patent Number: 4,912,612

[45] Date of Patent: Mar. 27, 1990

[54] TABLE LAMP

[75] Inventor: Giorgio Giorgi, Sao Paulo, Brazil

[73] Assignee: Artdemide Sidecard S.r.l., Milan, Italy

[21] Appl. No.: 381,755

[22] Filed: Jul. 18, 1989

[30] Foreign Application Priority Data

Jul. 19, 1988 [BR] Brazil ..... 8803984

[51] Int. Cl.[4] ..... F21V 21/18

[52] U.S. Cl. ..... 362/285; 362/418; 362/419

[58] Field of Search ..... 362/285, 410, 418, 419

[56] References Cited

U.S. PATENT DOCUMENTS

| | | | |
|---|---|---|---|
| 2,732,487 | 1/1956 | Crider | 362/410 |
| 4,238,816 | 12/1980 | Merlo | 362/419 X |
| 4,494,177 | 1/1985 | Matthews | 362/418 X |
| 4,692,850 | 9/1987 | LeDoux | 362/285 X |

*Primary Examiner*—Allen M. Ostrager

*Attorney, Agent, or Firm*—Klauber & Jackson

[57] ABSTRACT

A lamp comprising a base; a unit supporting a bulb; and adjustable means for connecting and enabling adjustment of the supporting unit in relation to the base; which connecting means substantially consist of a rigid helical spring, and an elbow type tube designed to slide along the spring between a position adjacent to the base and a position adjacent to the unit supporting the bulb.

13 Claims, 2 Drawing Sheets

TABLE LAMP

BACKGROUND OF THE INVENTION

The present invention relates to a table lamp particularly suitable for use as a reading lamp and/or professional lighting fixture (e.g. for drawing boards) enabling large part of the beam to be directed as determined by the user. In particular, the present invention relates to a lamp comprising a base; a bulb supporting unit; and adjustable means for connecting the same and enabling adjustment of the bulb supporting unit in relation to the base for directing the beam as required. Known lamps or spots of the aforementioned type usually present a fluorescent or incandescent bulb housed inside a concave shade and supported on a stand consisting of articulated metal rods, at times featuring a return spring. A major drawback of known supports of the aforementioned type is that the articulated joints on the rods and the helical spring eventually slacken, thus making it increasingly difficult to maintain the set position as selected by the user.

SUMMARY OF THE INVENTION

The aim of the present invention is to provide a table lamp enabling accurate, reliable, long-term vertical and horizontal adjustment of the bulb supporting unit in relation to the base.

With this aim in view, according to the present invention, there is provided a lamp comprising:

a base;

a bulb supporting unit; and adjustable means for connecting and enabling adjustment of said bulb supporting unit in relation to said base; characterized by the fact that said connecting means comprise:

an elastically deformable arm of such rigidity as to be substantially undeformed by its own weight or that of said supporting unit; and elbow type guide means designed to slide longitudinally along said arm between a position adjacent to said base and a position adjacent to said unit supporting said bulb.

BRIEF DESCRIPTION OF THE DRAWINGS

A preferred non-limiting embodiment of the present invention will be described by way of example with reference to the accompanying drawings, in which.

DETAILED DESCRIPTION OF THE INVENTION

Figures 1, 2:
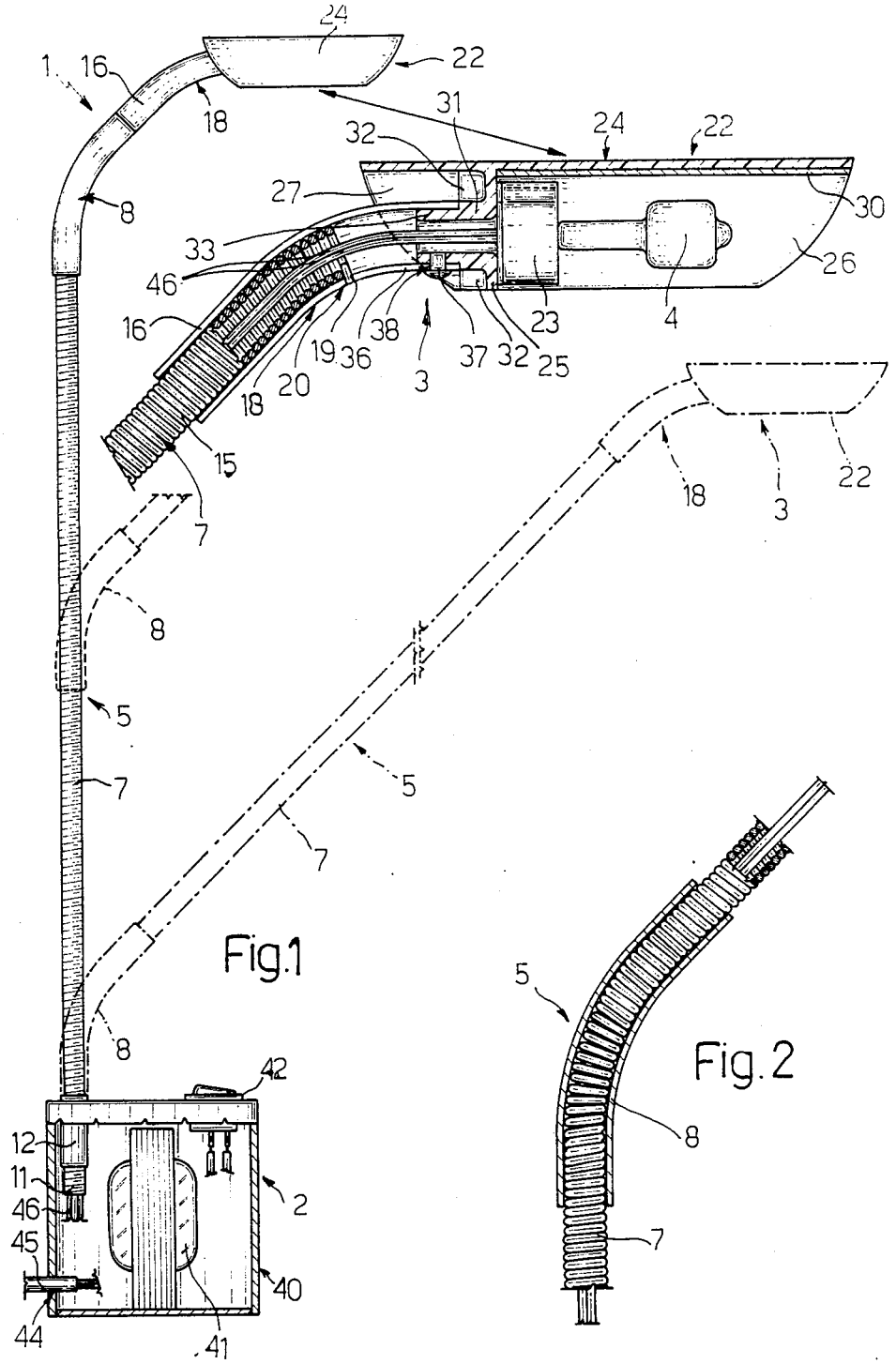
FIG. 1 shows a partially sectioned view of a lamp in accordance with the teachings of the present invention and in various operating positions.
FIG. 2 shows a larger-scale section of a detail in FIG. 1.

Number 1 in FIG. 1 indicates a table lamp comprising:

a base 2;

a unit 3 supporting a bulb 4; and adjustable means 5 for connecting and enabling adjustment of supporting unit 3 in relation to base 2 and so enabling the beam of lamp 4 to be directed as required by the user.

According to the present invention, said connecting means 5 comprise a rigid helical spring 7; and an elbow type guide tube 8 defining an obtuse angle and sliding longitudinally along spring 7 between a position adjacent to base 2 and a position adjacent to unit 3 supporting bulb 4. In particular, the rigidity of spring 7 is such that it is substantially undeformed by its own weight or that of supporting unit 3 in any of the operating positions shown in FIG. 1.

With reference to FIG. 2, the inside diameter of tube 8 is slightly larger than the outside diameter of spring 7, so as to enable tube 8 to slide in relation to spring 7 subsequent to force being applied by the user, while at the same time exchanging a certain amount of friction with spring 7 for maintaining the position selected by the user.

The obtuse angle defined by tube 8 is preferably 135°. As shown in FIG. 1, spring 7 extends perpendicularly from base 2, and presents a bottom end portion 11 secured in known manner to base 2, e.g. by means of an externally threaded coupling 12.

Spring 7 also presents a top portion 15 engaging a first portion 16 of a further tube 18 also forming part of said connecting means 5 and identical to said tube 8 by virtue of defining an obtuse angle of preferably 135°. Said tubes 8 and 18 and the obtuse angles of the same provide for positioning bulb 4 horizontally regardless of the position of tube 8 in relation to spring 7. Spring 7 presents a oop end appendix 19 (FIG. 1) engaging a radial through hole 20 in tube 18 for ensuring stable connection and preventigg withdrawal or rotation. Unit 3 supporting bulb 4 comprises a diffuser 22 and a bulb holder 23 with a pair of female terminals 21 into which respective terminals (not shown) on bulb 4 are fitted in use.

Diffuser 22 consists of a semitubular element 24 (FIGS. 1 and 3) having a semicircular radial dividing wall 25 substantially defining a first semicylindrical compartment 26 and a shorter second semicylindrical compartment 27.

Figures 3, 4:
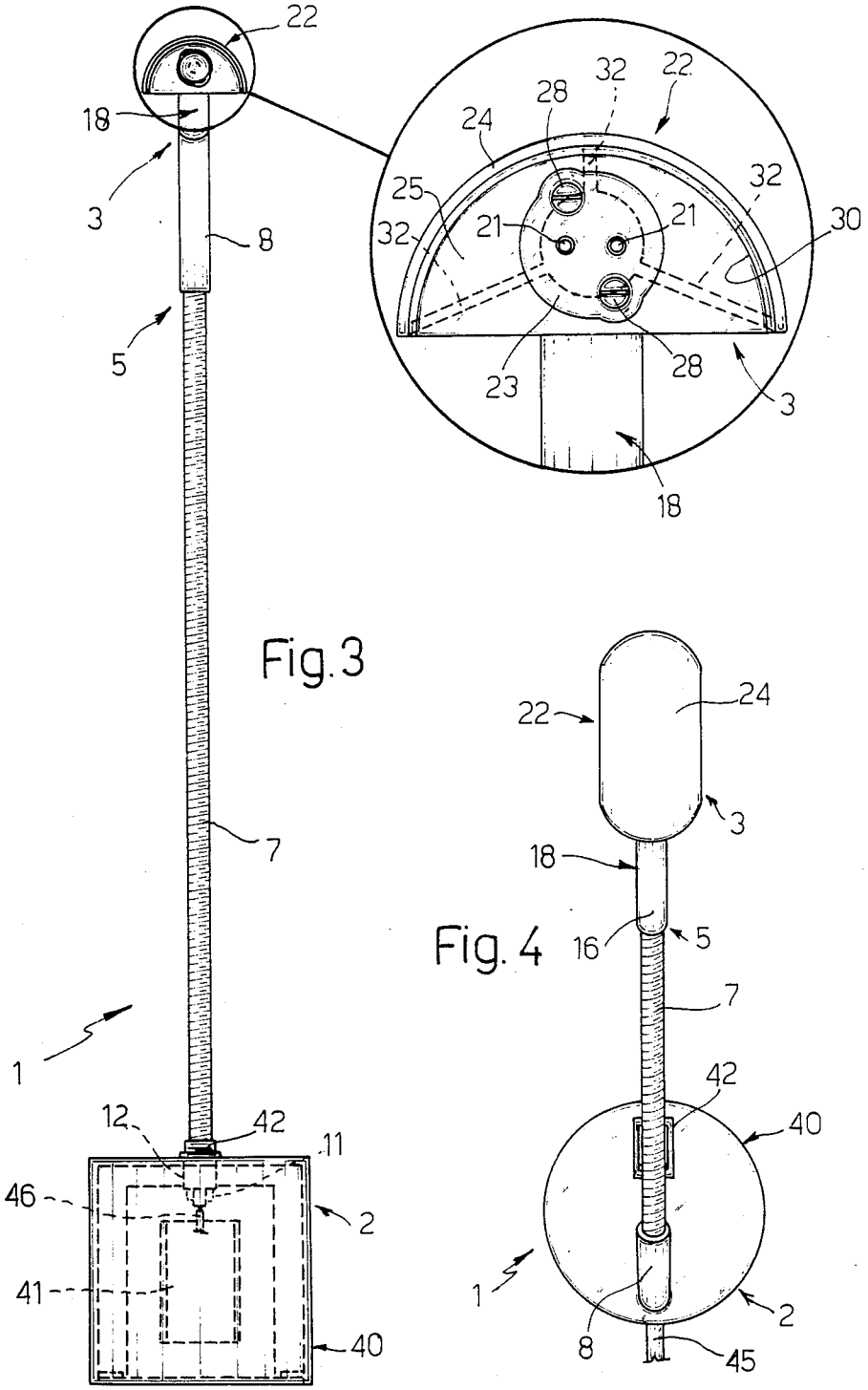
FIG. 3 shows a side view of the FIG. 1 lamp with the bulb removed for simplicity.
FIG. 4 shows a top view of the lamp in FIGS. 1 and 3.

Bulb 4 and respective bulb holder 23 are housed inside said first compartment 26, bulb holder 23 being secured to dividing wall 25 by means of a pair of screws 28 (FIG. 3).

Semitubular element 24 supports and houses a semitubular screen 30, primarily for protecting element 24 from the heat produced by bulb 4 and, secondly, for reflecting the light from bulb 4 outwards. Should element 24 be molded from plastic material, screen 30 may be formed as a metal (e.g. aluminium) insert, so as to obtain a complete diffuser 22 at the end of the molding stage. Dividing wall 25 extends inside second compartment 27 via an axial element 31 and three spokes 32 connecting the root portion of element 31 to the inner surface of element 24.

End 33 of element 31 engages a second portion 36 of tube 18, and is secured to the same via a plug 37 engaging a radial through hole 38 on end 33 (FIG. 1).

With reference to FIGS. 1 and 4, the opposite end surfaces of diffuser 22 present a curved profile, each defining a semicircle when viewed from the top (as shown in FIG. 4).

Base 2 substantially consists of a hollow cylindrical body 40 supporting spring 7 via coupling 12, and housing an electric transformer 41 and a switch 42. Said body 40 presents a through hole 44 through which is threaded a supply lead 45 controlled in known manner by switch 42 and connected to transformer 41. Transformer 41 is also connected to bulb holder 23 by a pair of leads 46 running inside spring 7.

Operation of lamp 1 is readily discernible from FIG. 1. When tube 8 is slid along or turned about the longitudinal axis of spring 7 by the user, spring 7 adapts to the set position of tube 8 as shown also in FIG. 2.

Consequently, unit 3 supporting bulb 4 may be set to a wide range of operating positions as regards both the vertical and horizontal distance of unit from base 2, said range substantially defining the lateral surface of a truncated cone, wherein the top circular edge is defined when tube 8 is set adjacent to tube 18, and the bottom (larger diameter) circular edge being defined when tube 8 is set adjacent to base 2.

The advantages of lamp 1 according to the present invention will be clear from the foregoing description. In particular, unit 3 supporting bulb 4 may be adjusted easily to a wide range of operating positions, while at the same time providing for long-term stability with no maintenance required.

Moreover, said adjustment is achieved using commonly used materials (spring and tube) thus enabling low-cost manufacture To those skilled in the art it will be clear that changes may be made to lamp 1 as described and illustrated herein without, however, departing from the scope of the present invention.

For example, rigid spring 7 may be replaced by a standard elastically deformable arm, providing rigidity is such as to prevent the arm from being deformed appreciably under its own weight or that of said supporting unit 3.

Also, diffuser 22 and tube 16 may be connected by forming an annular groove in place of through hole 38 in end 33 of element 31, thus enabling diffuser 22 to turn about its longitudinal axis and so direct the beam from bulb 4 not only downwards but also laterally or upwards.

I claim:

1. A lamp comprising:

a base;

a bulb supporting unit; and adjustable means for connecting and enabling adjustment of said bulb supporting unit in relation to said base; characterised by the fact that said connecting means (5) comprise:

an elastically deformable arm (7) of such rigidity as to be substantially undeformed by its own weight or that of said supporting unit (3); and elbow type guide means (8) designed to slide longitudinally along said arm (7) between a position adjacent to said base (2) and a position adjacent to said unit (3) supporting said bulb (4).

2. A lamp as claimed in claim 1, characterised by the fact that said elastically deformable arm (7) substantially consists of a helical spring (7).

3. A lamp as claimed in claim 2, characterised by the fact that said guide means (8) substantially consist of a tube (8) bent in such a manner as to define an obtuse angle.

4. A lamp as claimed in claim 3, characterised by the fact that said connecting means (5) comprise an auxiliary tube (18) mounted integral with the end (19) of said spring (7) opposite to that connected to said base (2), and connected mechanically to said unit (3) supporting said bulb (4).

5. A lamp as claimed in claim 4, characterised by the fact that said auxiliary tube (18) is bent in such a manner as to define an obtuse angle.

6. A lamp as claimed in claim 5, characterised by the fact that the sum of said obtuse angles is approximately 270°.

7. A lamp as claimed in claim 5, characterised by the fact that said obtuse angles are equal.

8. A lamp as claimed in claim 4, characterised by the fact that said tube (8) and said auxiliary tube (18) are substantially identical, and present an inside diameter slightly larger than the outside diameter of said spring (7).

9. A lamp as claimed in claim 4, characterised by the fact that said means (3) supporting said bulb (4) comprise a diffuser (22) and a bulb holder (23); said diffuser (22) substantially consisting of a semitubular element (24) having a semicircular dividing wall (25) substantially defining a first compartment (26) housing said bulb holder (23), and a second compartment (27) housing an end portion (36) of said auxiliary tube (18) and means for connecting said end portion (36) to said dividing wall (25).

10. A lamp as claimed in claim 9, characterised by the fact that said diffuser (22) presents a protective screen (30) designed to withstand the heat produced, in use, by said bulb (4); said screen (30) being mounted between said bulb (4) and said semitubular element (24).

11. A lamp as claimed in claim 9, characterised by the fact that said means connecting said end portion (36) and said dividing wall (25) provide for relative stable mechanical connection of said auxiliary tube (18) and said means (3) supporting said bulb (4).

12. A lamp as claimed in claim 9, characterised by the fact that said means connecting said end portion (36) and said dividing wall (25) provide for mechanical connection enabling relative rotation of said means (3) supporting said bulb (4) in relation to said auxiliary tube (18).

13. A lamp as claimed in claim 2, characterised by the fact that it comprises leads (46) for supplying said bulb (4) and housed inside said helical spring (7).

* * * * *

UNITED STATES PATENT AND TRADEMARK OFFICE

CERTIFICATE OF CORRECTION

PATENT NO. : 4,912,612

DATED : March 27, 1990

INVENTOR(S) : Giorgio Giorgi

It is certified that error appears in the above-identified patent and that said Letters Patent is hereby corrected as shown below:

ON THE TITLE PAGE OF THE PATENT, CHANGE THE NAME OF THE ASSIGNEE TO READ:

-- ARTEMIDE SIDECAR S.R.L. --

Signed and Sealed this

Thirteenth Day of October, 1992

*Attest:*

DOUGLAS B. COMER

*Attesting Officer*

*Acting Commissioner of Patents and Trademarks*